United States Patent [19]

Ogawa

[11] Patent Number: 4,575,346

[45] Date of Patent: Mar. 11, 1986

[54] MAGNETIC TOP RUNNING TOY

[75] Inventor: Iwakichi Ogawa, Kashiwa, Japan

[73] Assignee: Takara Co., Ltd., Tokyo, Japan

[21] Appl. No.: 525,549

[22] Filed: Aug. 22, 1983

[30] Foreign Application Priority Data

Aug. 28, 1982 [JP] Japan ..... 57-130405[U]

[51] Int. Cl.[4] ..... A63H 1/06; A63H 33/26; A63H 17/12; A63H 18/00

[52] U.S. Cl. ..... 446/259; 446/135; 446/256; 446/425; 446/444

[58] Field of Search ..... 446/129, 132, 135, 137, 446/138, 259, 256, 262, 264, 288, 136, 235, 257, 260, 429, 435, 444, 446, 168, 171, 172, 173

[56] References Cited

U.S. PATENT DOCUMENTS

| | | | |
|---|---|---|---|
| 484,850 | 10/1892 | Estell | 446/260 |
| 1,005,853 | 10/1911 | Lewis | 446/132 |
| 1,590,242 | 6/1926 | Howard | 446/256 X |
| 1,685,707 | 9/1928 | Keedy | 446/137 |
| 3,318,600 | 5/1967 | Glass et al. | 446/256 X |
| 3,591,181 | 7/1971 | Stewart | 446/259 X |
| 4,031,660 | 6/1977 | Chen | 446/132 X |
| 4,091,561 | 5/1978 | Kimura | 446/137 |
| 4,248,426 | 2/1981 | Sims et al. | 446/259 X |
| 4,408,413 | 10/1983 | Hyland et al. | 446/138 |

FOREIGN PATENT DOCUMENTS

| | | | |
|---|---|---|---|
| 733265 | 5/1966 | Canada | 446/138 |

*Primary Examiner*—Robert A. Hafer
*Assistant Examiner*—D. Neal Muir
*Attorney, Agent, or Firm*—Joseph W. Price

[57] ABSTRACT

Disclosed is a magnetic top running toy wherein a spinning top is run along a running path. The magnetic top running toy includes a top having a magnetic shaft and a running path having a magnetic attraction wall adapted to contact with the magnetic shaft of the top when the top runs along the running path. The running path is constructed as a reciprocative running path permitting the top to turn at both ends thereof. A starting station and a jumping station are attached to the running path. The starting station has a guide surface for guiding the top onto the running path. The jumping station is adapted to allow the top guided from the running path to fly therefrom while keeping the top to spin.

10 Claims, 10 Drawing Figures

MAGNETIC TOP RUNNING TOY

BACKGROUND OF THE INVENTION

The present invention relates to a magnetic top running toy which is adapted to spin a top having a magnetic rotating shaft along parallel reciprocative running paths having a magnetic attraction wall interposed therebetween. More particularly, the invention relates to a magnetic top running toy adapted to allow the rotating shaft to be magnetically attracted to the magnetic attraction wall so that the top runs along the reciprocative running paths by obtaining a propulsive force through the rotation thereof.

SUMMARY OF THE INVENTION

The present invention provides a magnetic top running toy wherein a spinning top is run along a running path. The magnetic top running toy includes a top having a magnetic shaft and a running path having in the longitudinal direction thereof a magnetic attraction wall adapted to contact with the magnetic shaft of the top when the top runs along the running path. The running path is constructed as a reciprocative running path permitting the top to turn at both ends thereof. A starting station is attached to the running path and has a guide surface for guiding the top onto the running path. In addition, a jumping station is attached to the running path and is adapted to allow the top guided from the reciprocative running path to fly therefrom.

The features of the present invention, which are believed to be novel, are set forth with particularity in the appended claims. The present invention, both as to its organization and manner of operation, together with further objects and advantages thereof, may best be understood by reference to the following description, taken in conjunction with the accompanying drawings.

BRIEF DESCRIPTION OF THE DRAWINGS

FIG. 7(*b*) is a sectional view taken along the line VII—VII of FIG. 7(*a*).

DESCRIPTION OF THE PREFERRED EMBODIMENTS

Figure 1:
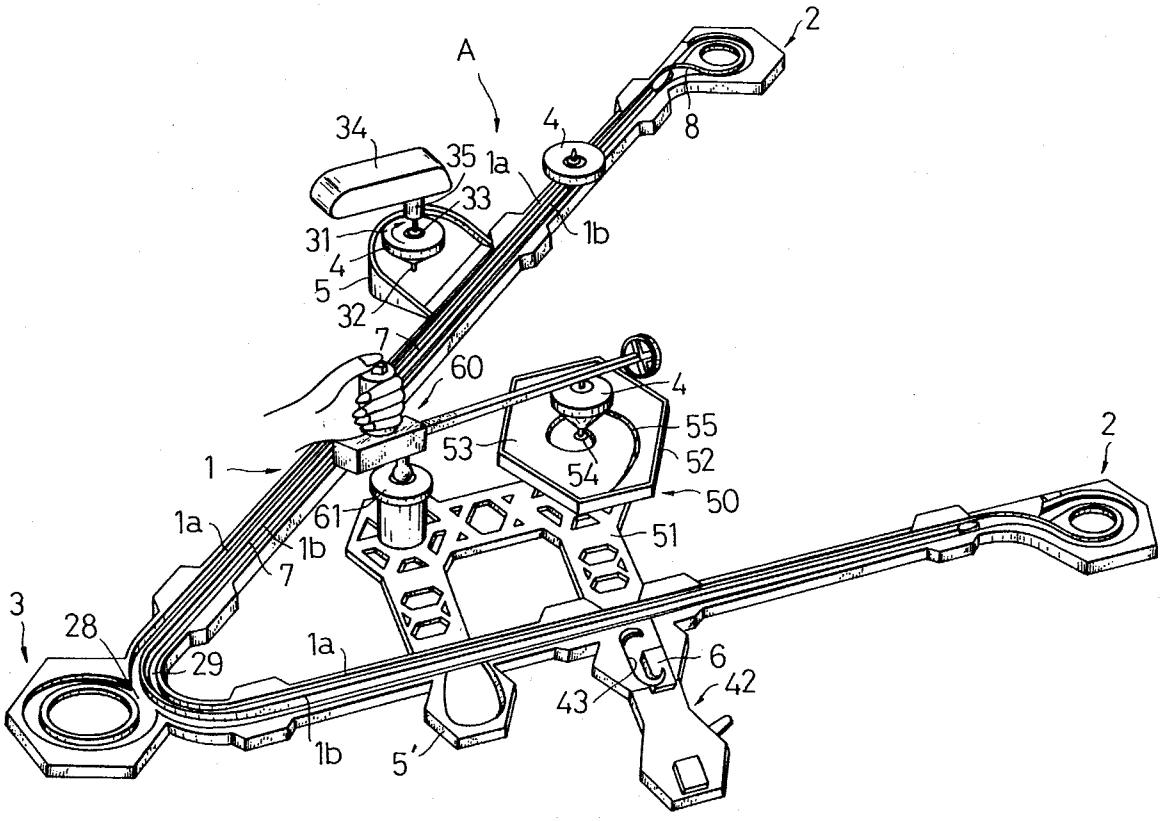
FIG. 1 is a perspective view of the whole of a magnetic top running toy in accordance with the invention.

The following description is provided to enable any person skilled in the toy field to make and use the invention and sets forth the best modes contemplated by the inventor for carrying out his invention. Various modifications, however, will remain readily apparent to those skilled in the toy field, since the generic principles of the present invention have been defined herein specifically to provide a relatively economical and easily manufactured magnetic top running toy. The primary object of the invention is to provide a new and unique magnetic top running toy that permits the top to smoothly start from a starting station along the running path as well as to fly from a jumping station. The endless mode of running and the jumping action of the top enhances the play value and interest of the child in the magnetic top running toy.

First of all, in the drawings, a symbol A denotes a magnetic top running toy, in which an endless magnetic top running path 1 is provided. The running path 1 is constituted by two linear reciprocative running paths 1 each having on one end thereof a point section 2 where a magnetic top 4 can turn, the reciprocative running paths 1 being interconnected in a substantially V shape through a course changing path 3, thereby allowing the magnetic top 4 to run recirculatively. A starting plate 5 has a space large enough for driving the magnetic top 4 to spin and is adapted to guide the spinning magnetic top 4 to the running path 1. Moreover, a jump plate 6 is provided to allow the magnetic top 4 which is guided from the running path 1 and is held in a stationarily spinning state, to be propelled upwardly.

The above-mentioned constituent members will be described hereinunder in detail.

Figure 2A:
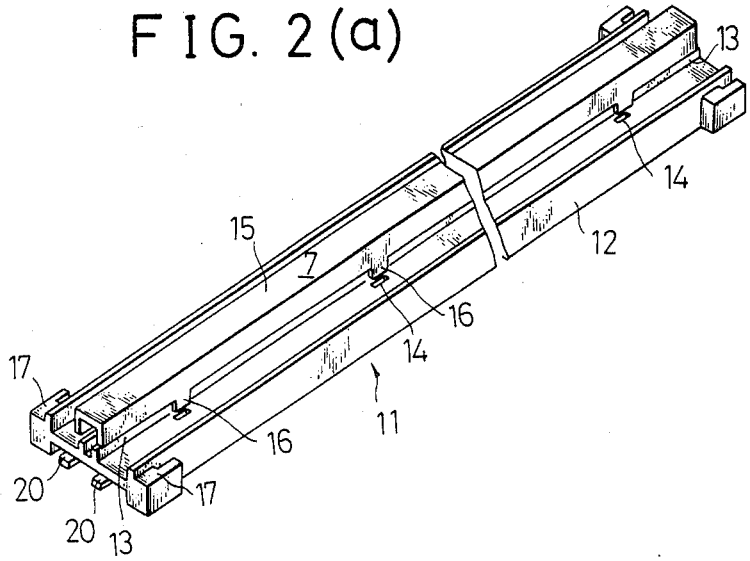
FIGS. 2(*a*) and 2(*b*) in combination illustrate the assembly of a running path.
Figure 2B:
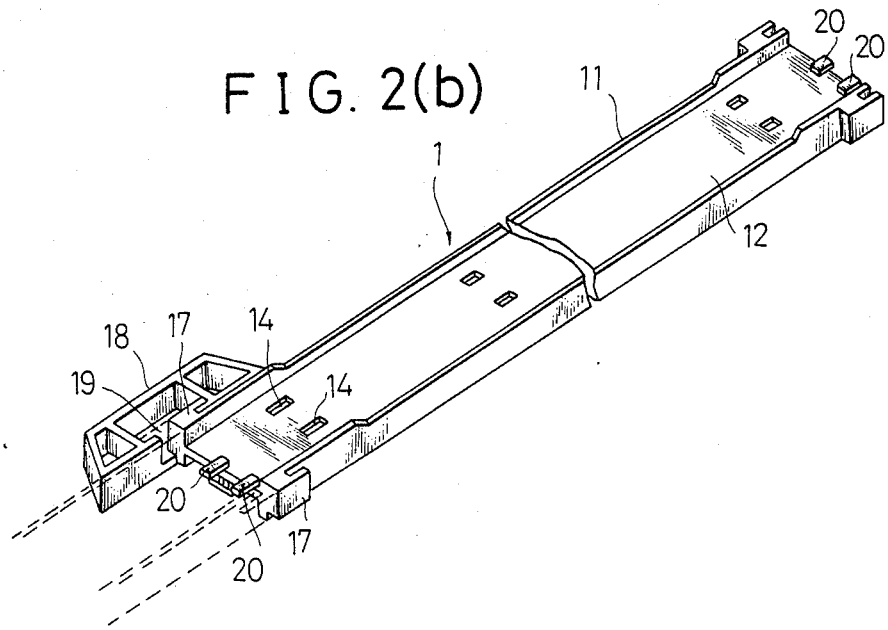

First, the reciprocative running path 1 is constituted by an outward running path 1*a* and a return running path 1*b* which are formed linearly and in parallel to each other with a magnetic attraction wall 7 interposed therebetween. Such a running path 1 can be formed by coupling unit rail bodies 11 together, as shown in FIGS. 2(*a*) and 2(*b*). Each unit rail body 11 is constituted by a rail body 12 of substantially H-shaped cross section made of a synthetic resin or a non-magnetic metal such as aluminum and the like and having a pair of longitudinal elongated protrusions 13 formed along the upper surface of a web portion thereof as well as claw receiving openings 14 formed in the upper surface of the web portion, and an iron plate of U-shaped cross section. A strip-like magnetic member 15 constituting the magnetic attraction wall 7 is provided with claws 16 projecting from the lower part thereof with proper spacings. The magnetic strip member 15 is placed on the elongated protrusion 13 of the rail body 12, and the claws 16 are projected from the respectrive claw receiving openings 14 toward the lower surface of the web portion and bent to fix the magnetic strip member 15, thereby to obtain a unit rail body 11. The unit rail body 11 having the above-described construction has coupling members 17 of L-shaped cross section projected from both the outer side surfaces of each end thereof. The adjacent unit rail bodies 11 can be coupled together in such a way that the end surfaces of the adjacent unit rail bodies 11 are aligned with each other, and, as shown in FIG. 2(*b*), the corresponding coupling members 17 of both of them are butted against each other in a T shape, and then the T-shaped butt coupling members 17, 17 are unitarily fitted into a fitting groove 19 in a coupler 18. In this case, if projections 20 for regulating the running surface are formed projecting from both end surfaces of each rail body 12, then the running surfaces at the coupling portions of both the rail bodies 12, 12 can be prevented from differing in level from each other, thereby making it possible to obtain a flat running surface. It is to be noted that such an arrangement is possible that the coupler 18 is previously secured to either one of the adjacent rail bodies and is employed for coupling the other rail body thereto. It is to be noted also that the above-described assembly and construction of the reciprocative running path 1 are not especially limitative thereto. In addition, the magnetic attraction wall 7 is only required to be provided according to the running conditions and is not always necessary to provide over the entire length of the running path 1.

Figure 3:
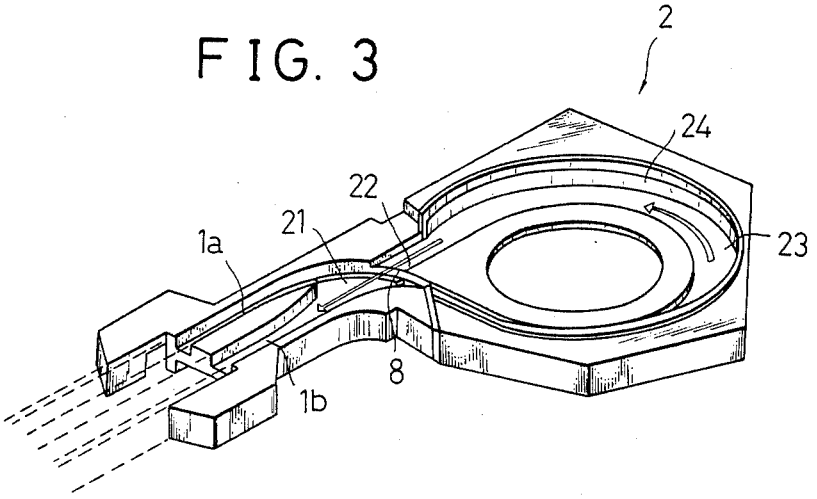
FIG. 3 is an enlarged perspective view of a point section.

Referring to FIG. 3, the point section 2 is connected to one end of the linear running path 1 and is adapted to turn the magnetic top 4 thereby to change over the course of the top from the outward running path 1*a* to the return running path 1*b*. The point section 2 has an entering path 21 and a leaving path 22 crossing each other as well as a turning path 23 which are formed in a substantially α shape. The outward running path 1*a* is connected to the turning path 23 through the entering path 21, while the turning path 23 is connected to the return running path 1*b* through the leaving path 22. The entering path 21 and the leaving path 22 three-dimensionally cross each other, with a difference in level therebetween. A guide wall 8 is formed rising outside the entering path 21, and the leaving path 22 continued from the turning path 23 is formed on the upper surface of the guide wall 8. The turning path 23 is formed in a substantially C shape and has a proper magnetic attraction wall 24 formed on the outside inner peripheral wall thereof. It is to be noted that the end portion of the magnetic attraction wall 24 on the running path 1 is preferably a non-magnetic wall having no magnetic attraction force in order to allow the magnetic top 4 to smoothly enter and leave the point section 2.

Another point section 2 having the same construction as that of the above-mentioned point section 2 is provided at the end portion of the other reciprocative running path 1.

Figure 4:
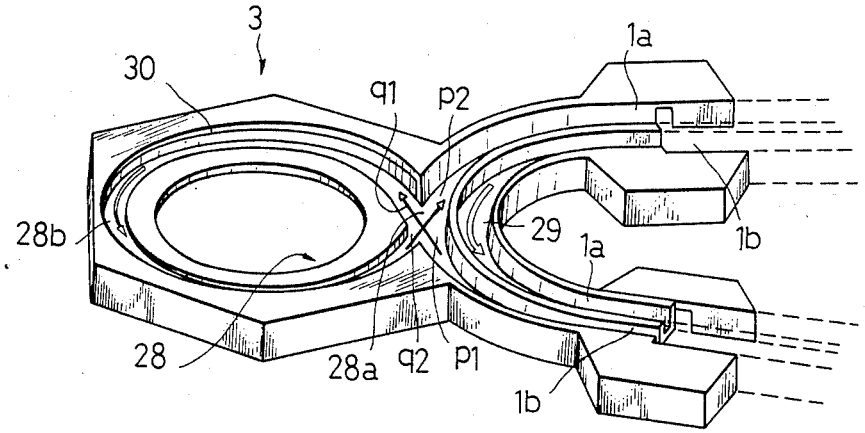
FIG. 4 is an enlarged perspective view of a course changing path.

The reciprocative running paths 1 having the above-described construction are interconnected in a V shape through the course changing path 3. More specifically, as shown in FIG. 4, the course changing path 3 has a substantially α-shaped course changing path 28 outside thereof as well as a substantially U-shaped course changing path 29 inside thereof. On the outside, the outward running path 1*a* is connected to the return running path 1*b* through the substantially α-shaped course changing path 28, while on the inside, the return running path 1*b* is connected to the outward running path 1*a* through the substantially U-shaped course changing path 29. The substantially α-shaped course changing path 28 is adapted to change the course of the magnetic top 4 by running the same so as to turn through crossing. The substantially α-shaped course changing path 28 is constituted by a crossing portion 28*a* and a substantially C-shaped changing path 28*b* and arranged so that the magnetic top 4 can run while crossing the outward running path 1*a* and the return running path 1*b*. The path surface is flat at the crossing portion 28*a*, and entrance/exit openings p1, p2 of the running path 1 and entrance/exit openings q1, q2 of the substantially C-shaped changing path 28*b* face each other to form guide walls, respectively. It is to be noted that a proper magnetic attraction wall 30 is formed on the outside inner peripheral wall of the substantially C-shaped changing path 28*b*.

Figure 5:
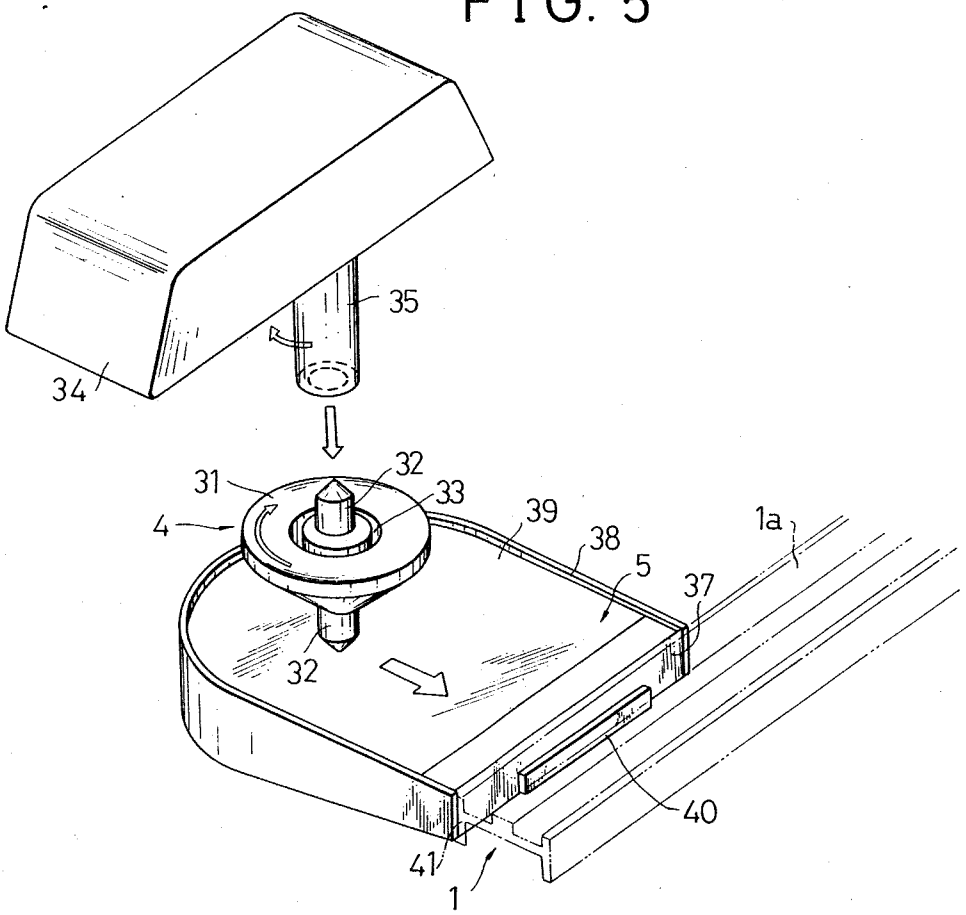
FIG. 5 is an enlarged perspective view of a starting station.

Referring to FIG. 5, the magnetic top 4 has a main body 31 made of a synthetic resin or the like and a magnetic rotating shaft 32. The main body 31 has an annular groove 33 formed coaxially with the rotating shaft 32. A reference numeral 34 designates an energizer having a motor (not shown) incorporated therein and a cylindrical rotating shaft 35 interlocking with the motor. When the switch of the motor is turned ON to rotate the cylindrical rotating shaft 35, and when the shaft is inserted into the annular groove 33 in the main body 31 of the magnetic top 4, the magnetic top 4 is given a rotational force through the contact friction.

Moreover, the starting plate 5 has a proximal side portion 37 coming in contact with an outer side surface of the running path 1 and a guide slant surface 39 gradually increasing in height from the upper end of the proximal side portion 37 toward one side as well as having a peripheral wall 38. The proximal side portion 37 has an engaging member 40 projecting from the lower end portion thereof. The starting plate 5 is connected to a side of the running path 1 by engaging the engaging member 40 with a lower leg member 41 of the rail body 11. In this case, the end surface of the guide slant surface 39 is set so as to be continuous with the outward running path 1*a* of the running toy. It is to be noted that it is not always necessary to limit the number of the starting plate 5 to one and any desired number of starting plates 5 may be provided.

To run the magnetic top 4 along the running path 1 having the above-described construction, first, the magnetic top 4 is spun clockwise by the energizer 34 on the starting plate 5. Since the starting plate 5 has a sufficiently wide area, the magnetic top 4 can easily spin. Then, the magnetic top 4 lowers along the slant surface 39 of the starting plate 5 to fall onto the outward running path 1*a*. At this time, the shaft 32 of the magnetic top 4 is magnetically attracted to the magnetic attraction wall 7 of the running path 1. Since the magnetic top 4 is spinning, the spinning motion is converted into a linear motion. Obtaining a propulsive force thereby, the magnetic top 4 starts to run along the outward running path 1*a*. Being guided by the guide wall 8 of the entering path 21 of the point section 2, the magnetic top 4 enters the turning path 23 through the end of the outward running path 1*a* and leaves after running along the turning path 23 while making a turn, and then enters the return running path 1*b* through the leaving path 22 crossing the entering path 21 on the guide wall 8. While running along the turning path 23, the magnetic top 4 is accelerated by the running inertia and the centrifugal force. Moreover, if the magnetic attraction wall 24 is provided on the outside inner peripheral wall of the turning path 23, the rotating shaft 32 is magnetically attracted to the magnetic attraction wall 24. Therefore, the propulsive force generated by the spin of the magnetic top 4 itself is also added, so that the running performance is hardly attenuated and is maintained for a long time. It is to be noted that since the magnetic top 4 has a strong self-supporting property through the spin, there is no possibility that the magnetic top 4 falls down even if the same turns suddenly. The magnetic top 4 running from the point section 2 and passing through the return running path 1*b* enters the substantially U-shaped course changing path 29 through one end of the running path to change the course thereof and enters the outward running path 1*a* of the other running path 1 to continue running, and then turns at the point section 2 similarly to the above to enter the return running path 1*b* and reaches the crossing portion 28*a* of the course changing path 3 from the end of the return running path 1*b*. In this case, since the exit opening p1 of the return running path 1*b* and the entrance opening q1 of the substantially C-shaped changing path 28*b* face each other to constitute guide walls, the magnetic top 4 advances along these guide walls and runs along the substantially C-shaped changing path 28*b* while making a turn thereby to change its course and leaves being accelerated similarly to the case of the point section 2. Also in this case, since the exit opening q2 faces the entrance opening p2 of the other outward running path 1*a*, the magnetic top 4 enters the outward running path 1*a* while being guided by the path walls of these openings and further runs to return to the starting position, and then the magnetic top 4 recirculates while repeating the same movement.

Figure 6B:
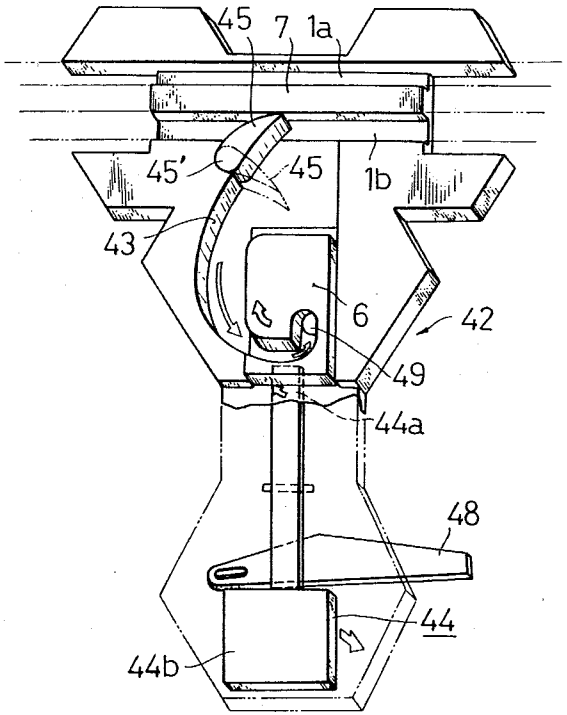
FIGS. 6(*a*) and 6(*b*) in combination illustrate a jumping station.
Figure 6A:
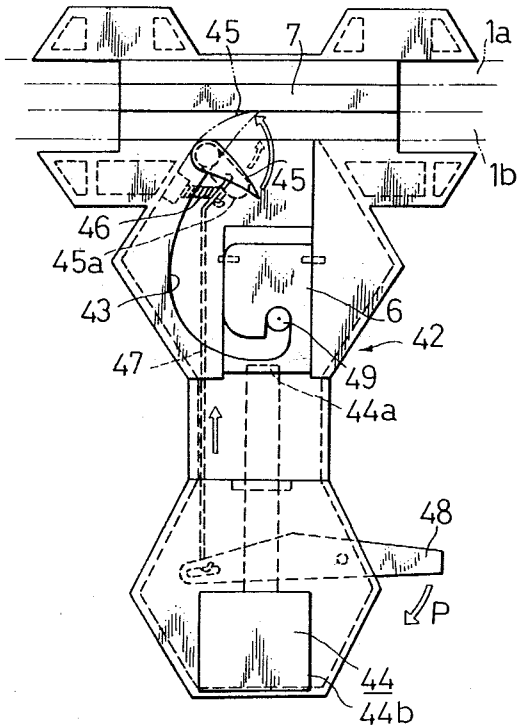

Referring to FIGS. 6(*a*), 6(*b*), a reference numeral 42 denotes a jump board which is constituted by a changeover guide path 43 for guiding the magnetic top 4 passing through the running path 1 to a jump plate 6, the jump plate 6 for flying the magnetic top 4, and a springing plate 44 for springing up the jump plate 6, and is connected to a side of the running path 1. The changeover guide path 43 has a running changeover member 45 provided on one end thereof, and the base portion 45' of the changeover member 45 is pivotally attached to the jump board 42 as well as secured unitarily with a pivoting member 45*a* at the reverse side of the jump board 42 and is pulled inwardly by a spring 46. The end of the pivoting member 45*a* is coupled to an end of an operating lever 48 through a connecting rod 47. Accordingly, when the lever 48 is pushed in the direction of the arrow P, the connecting rod 47 is moved in the direction opposite to the arrow direction to pivot the pivoting member 45*a* against the spring force of the spring 46, so that the changeover member 45 is pushed toward the running path 1 to come in close contact with the inner wall thereof. Thereby, the running path 1 and the guide path 43 are made continuous with each other, so that the running path for the magnetic top 4 is changed over and consequently, the magnetic top 4 is guided to the jump plate 6. A stationary spin hole 49 is formed in the terminating end portion of the guide path 43. The jump plate 6 is supported at the front end thereof, and the rear end thereof is free and is adapted to be able to be sprung up by the springing plate 44. The springing plate 44 is swingably supported at a substantially central portion thereof. The front end 44*a* of the springing plate 44 is disposed below the rear end of the jump plate 6, while the rear end 44*b* thereof is exposed on the jump board 42 so as to be able to be pushed down. Accordingly, when the rear end 44*b* of the springing plate 44 is strongly pushed down, the front end 44*a* is raised by the lever action, causing the jump plate 6 to be sprung upwardly.

A reference numeral 50 in FIG. 1 designates a receiving board for receiving the flying magnetic top 4. The receiving board 50 is provided above a lower frame body 51. A receiving surface 53 of the receiving board 50 surrounded with a peripheral wall 52 is dished so as to be slant toward a stationary spin groove 54 formed in the center thereof and has a spiral guide elongated protrusion 55 formed thereon.

It is to be noted that the top-receiving board 50 is only required to have the top-receiving surface 53 which is planar and is not always necessary to have the slant surface, spiral elongated protrusion or stationary spin groove.

To fly the top by employing the jump plate 6 having the above-described construction, the changeover member 45 for changing the running path 1 is projected out on the running path 1 through the operation of the lever 48 of the jump board 42 so that the running path 1 and the guide path 43 are made continuous with each other. Thereby, the magnetic top 4 coming while running along the running path 1 is guided to the jump plate 6 so as to spin on the stationary spin hole 49 on the jump plate 6. Then, when the springing plate 44 is strongly pushed down, the jump plate 6 is largely sprung up, thereby allowing the magnetic top 4 to fly. The flying magnetic top 4 falls onto the receiving board 5 and is prevented from falling off outwardly by the peripheral wall 52 on the upper surface of the receiving board 50. The magnetic top 4 is guided along the slant receiving surface 53 on the upper surface of the receiving board 50 and the guide elongated protrusion 55 to the central stationary spin groove 54 to spin stationarily.

It is to be noted that it is preferable not to provide any magnetic attraction wall at this portion, in order to allow the running path to be smoothly changed over by means of the running path changeover member 45.

Thus, by providing the jump plate 6, the magnetic top 4 can not only run along a plane but also fly upwardly; hence, it is possible to utilize an idle space three-dimensionally.

Figure 7A:
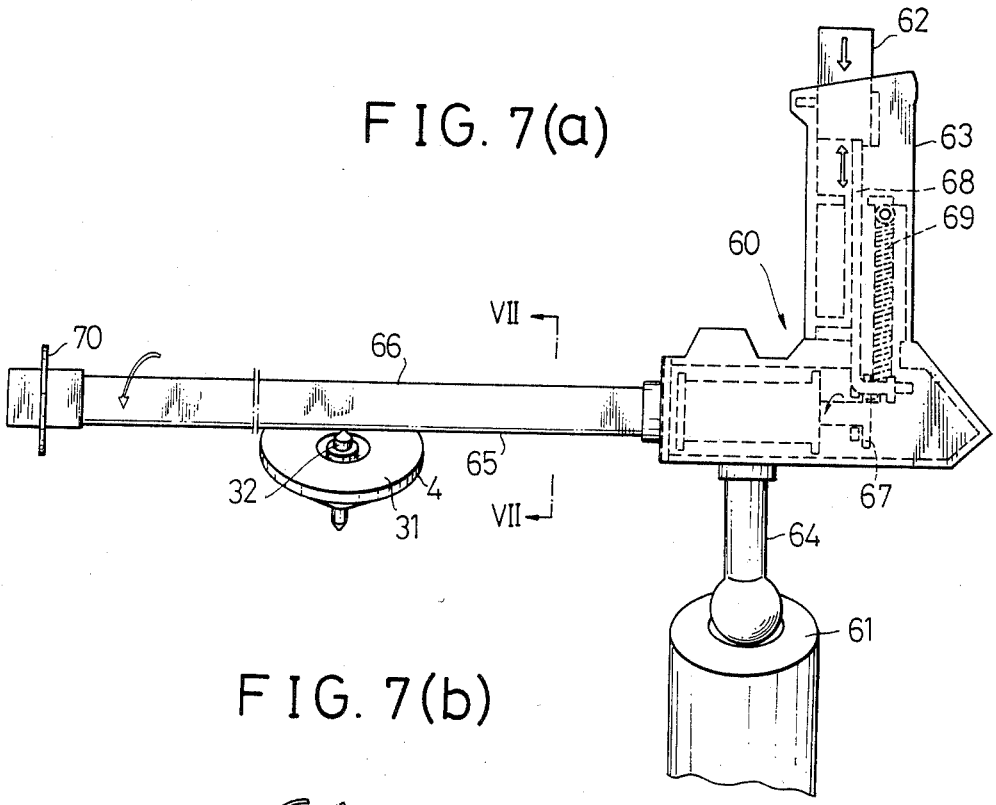
FIG. 7(*a*) is a side elevational view of a crane body.
Figure 7B:
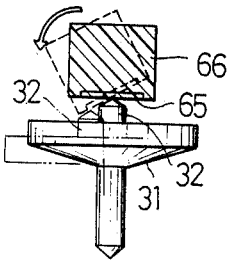

It is to be noted that in FIG. 1 a reference numeral 60 designates a crane body, which is operated on a support 61 on the lower frame 51 for moving the stationarily spinning magnetic top 4 in the groove 54 to a proper position while keeping the magnetic top 4 to spin. More specifically, as shown in FIGS. 7(*a*), the crane body 60 is provided with an operating main body having a push button 62 as well as a grip 63, a fulcrum rod body 64 projecting from the lower part of the main body, and a crane arm 66 projecting from a side of the operating main body as well as having a magnetic plate 65 provided on the lower surface thereof and able to revolve in response to the pushing operation of the push button 62. A rotating plate 67 is mounted inside the operating main body so as to be coaxial with the crane arm 66 and is coupled to the push button 62 through a rod 68. In addition, the rotating plate 67 is normally biased toward one side by a spring 69. When the push button 62 is depressed, the rod 68 is lowered to revolve the rotating plate 67 against the bias force of the spring 69. Simultaneously, also the magnetic plate 65 on the lower surface of the crane arm 66 is revolved. The revolving angle is only required to be about 90 degrees. If the push button 62 is released, the crane arm 66 is also returned.

To move the magnetic top 4 by employing the crane body 60, the crane body 60 is mounted on the support 61, and the lower surface of the crane arm 66 is brought into contact with the upper end of the rotating shaft 32 of the spinning magnetic top 4 so that the rotating shaft 32 of the magnetic top 4 is magnetically attracted to the magnetic plate 65. Under this state, the crane arm 66, together with the magnetic top 4, is lifted up, and while the top 4 is moved to a proper position in the longitudinal direction of the arm 66, the direction of the arm 66 is changed to drop the magnetic top 4 on a desired position of the toy. At this time, the fulcrum rod body 64 can be moved in all directions; hence, it is easy to change the direction of the arm 66. When the magnetic top 4 is moved along the lower surface of the crane arm 66, it is only necessary to slant the arm 66. If the arm end is lowered, the magnetic top 4 advances toward the end while spinning, while if the end is raised, the magnetic top 4 moves toward the side opposite to the end. It is to be noted that a stopper 70 provided on the arm end prevents the magnetic top 4 from advancing beyond the stopper 70 so that the same will not fall off. On the other hand, when the magnetic top 4 is dropped, the push button 62 is depressed. Consequently, the crane arm is revolved about 90 degrees; therefore, the rotating shaft 32 of the magnetic top 4 loses the attraction surface offered by the magnetic plate 65 and falls.

Accordingly, for example, if the magnetic top 4 stationarily spinning on the jump plate 6 or the receiving board 50, as described above, is moved onto the starting plate 5 in the above-described manner, the magnetic top 4 is guided to the running path 1 again and can continue running. Thus, the crane body 60 permits the magnetic top 4 to be moved to any desired position while permitting the same to spin. Therefore, unless the spinning force of the magnetic top 4 is lost, the movement thereof can be continued without any suspension.

It is to be noted that the running path 1 for the magnetic top 4 is not always limitative to the running path formed in a V shape such as the illustrated example. The running path 1 may be of simple I shape, or the running path 1 may be continuously formed in a W or other shapes.

In addition, the starting plate 5 must be disposed so as to correspond to the spinning direction of the magnetic top 4 and the advancing direction depends thereon.

As has been described in detail, the running path of the magnetic top running toy in accordance with the invention has along the center thereof the magnetic attraction wall contacted by the rotating shaft of the magnetic top and is a reciprocative running path permitting the magnetic top to turn at both ends thereof. Therefore, it is possible to run the magnetic top recirculatively. Moreover, since the starting plate having the guide surface for guiding the magnetic top into the reciprocative running path is provided at a proper position along a side of the running path, it is possible to smoothly start the magnetic top. Further, since the jump plate is provided which is adapted to allow the magnetic top guided from the reciprocative running path to fly while keeping the magnetic top spinning, it is possible to make the magnetic top run planarly as well as fly three-dimensionally. Thereby, the play with the magnetic top can be varied. In addition, since the top itself has the shape of what can be called a U.F.O., if the running toy is assembled so as to look like a space station as a whole, for example, as the illustrated example, then it is also possible to further improve the visual effect of the flying of the magnetic top.

These and other modifications of the present invention could be easily accomplished by a person of ordinary skill once given the generic principles of the present invention. Accordingly the scope and spirit of the present invention should be determined only from the following claims:

What is claimed is:

1. A magnetic top running toy assembly wherein a spinning top is run along a predetermined running path, comprising:

a top having a magnetic shaft;

a running path having a magnetic attraction wall adapted to contact with said magnetic shaft of said top when the top runs along the running path;

a starting station attached to said running path and having a guide surface for guiding said top onto said running path; and a jumping station attached to said running path including means for directing said top, while spinning, to a specific location, and means for impacting said spinning top at said specific location with sufficient force to propel it into the air including a lever mounted to transfer force to the bottom of a spinning top to propel said top into the air upon the application of an impacting force downward upon the said lever's exposed end.

2. The invention of claim 1 further including means for receiving said impacted spinning top after it is propelled into the air.

3. The invention of claim 1 wherein said means for directing includes a pivotal changeover member that can be positioned across said running path to direct said spinning top to said specific location.

4. The invention of claim 2 wherein said means for receiving includes a receiving board with a spiral guide protrusion mounted vertically higher than said path.

5. The invention of claim 2 further including a movable member positioned adjacent the means for receiving and having a magnetic plate for contacting and attracting said spinning top with sufficient force to lift it off of the means for receiving.

6. The invention of claim 5 further including means for rotating the movable member to release the spinning top.

7. The invention of claim 3 further including a bias spring for forcing the changeover member to a retracted position and a lever connected to the changeover member and operable by an operator to subjectively contact the spinning top.

8. The invention of claim 2 further including a movable member positioned adjacent the path and having a magnetic plate for contacting and attracting the spinning top with sufficient force to lift it.

9. The invention of claim 8 further including means for rotating the movable member to release the spinning top.

10. In a toy spinning top assembly having a path defining a plane of travel for directing the relative translation of a spinning top, the improvement comprising:

a jumping station cooperatively associated with the path including means for isolating the top from movement along the path and means for imparting sufficient force to propel the top into the air away from the plane of the path comprising a lever mounted to transfer force to the bottom of a spinning top to propel said top into the air upon the application of an impacting force downward upon the said lever's exposed end.

* * * * *